US006114288A

United States Patent [19]

Fujitsu et al.

[11] Patent Number: 6,114,288

[45] Date of Patent: Sep. 5, 2000

[54] LUBRICATING OIL COMPOSITION FOR INTERNAL COMBUSTION ENGINES

[75] Inventors: Takashi Fujitsu; Koichi Kubo; Mitsuhiro Nagakari, all of Kanagawa pref., Japan

[73] Assignee: Shell Research Limited, United Kingdom

[21] Appl. No.: 09/304,020

[22] Filed: May 3, 1999

[30] Foreign Application Priority Data

May 1, 1998 [JP] Japan ..... 10-137564

[51] Int. Cl.[7] ..... C10M 129/76; C10M 137/02

[52] U.S. Cl. ..... 508/371; 508/376; 508/378; 508/551

[58] Field of Search ..... 508/371, 551, 508/376, 378

[56] References Cited

U.S. PATENT DOCUMENTS

| | | | |
|---|---|---|---|
| 3,684,695 | 8/1972 | Neel et al. | 208/110 |
| 3,761,404 | 9/1973 | Calow et al. | 252/39 |
| 3,772,169 | 11/1973 | Small et al. | 252/56 |
| 3,775,329 | 11/1973 | Eckert | 252/59 |
| 3,869,396 | 3/1975 | Van de Kraats et al. | 252/56 |
| 4,033,888 | 7/1977 | Kiovsky | 252/56 |
| 4,280,916 | 7/1981 | Richards et al. | 252/33.4 |
| 4,330,471 | 5/1982 | van der Voort | 548/546 |
| 4,358,565 | 11/1982 | Eckert | 525/280 |
| 4,427,834 | 1/1984 | Martin | 525/280 |
| 4,462,918 | 7/1984 | Matthews et al. | 252/32.7 |
| 4,490,267 | 12/1984 | Eckert | 252/56 |
| 5,021,173 | 6/1991 | Waddoups et al. | 252/35 |
| 5,688,748 | 11/1997 | Tomizawa | 508/363 |
| 5,719,109 | 2/1998 | Tokashiki et al. | 508/364 |
| 5,728,656 | 3/1998 | Yamaguchi et al. | 508/371 |
| 5,744,430 | 4/1998 | Inoue et al. | 508/295 |
| 5,962,381 | 10/1999 | Bovington | 508/501 |

FOREIGN PATENT DOCUMENTS

| | | | |
|---|---|---|---|
| 1350257 | 4/1974 | United Kingdom | C10G 23/02 |
| 1440230 | 6/1976 | United Kingdom | C10G 34/00 |
| 1493620 | 11/1977 | United Kingdom | C10G 23/02 |
| 1493928 | 11/1977 | United Kingdom | C10G 23/16 |
| 1543359 | 4/1979 | United Kingdom | C08F 8/14 |

*Primary Examiner*—Margaret Medley
*Assistant Examiner*—Cephia D. Toomer
*Attorney, Agent, or Firm*—Kim Muller

[57] ABSTRACT

Lubricating oil composition for internal combustion engines having a high temperature shear viscosity of from 2.1 to less than 2.9 mPas wherein the lubricating base oil comprises 1) a zinc dialkyldithiophosphate, 2) a metallic detergent chosen from calcium alkylsalicylate and a mixture of calcium alkylsalicylate and magnesium alkylsalicylate and optionally 3) friction modifier.

6 Claims, No Drawings

LUBRICATING OIL COMPOSITION FOR INTERNAL COMBUSTION ENGINES

FIELD OF THE INVENTION

The present invention relates to a lubricating oil composition for internal combustion engines, more specifically, it relates to a lubricating oil composition for internal combustion engines which has excellent anti-wear properties with respect to moving valve parts in four-stroke engines.

BACKGROUND OF THE INVENTION

The most important parts requiring lubrication in an internal combustion engine are the three moving valve parts comprising the space between the piston and the cylinder, the bearings and other such bearing parts and the cam and tappet. Of these, the moving valve mechanism which opens and closes the intake valve and the exhaust valve in accordance with the timing of the combustion is an important part which governs the motive efficiency of the internal combustion engine, and it is well known that even when the internal combustion engine is lubricated, the lubrication conditions for this part are very exacting. The prevention of wear and seizure (scuffing) of this part is very important for the long-term retention of the motive efficiency and the reliability of the internal combustion engine. Consequently, wear resistance with respect to the moving valve parts is an important indispensable requirement for lubricating oils for internal combustion engines, and has therefore been included in domestic standard tests for appraising the quality and performance of lubricating oils for internal combustion engines.

Organometallic phosphorus compounds such as zinc dialkyldithiophosphates (ZnDTP) are added to lubricating oils for internal combustion engines as anti-wear agents. However, it has long been feared that these phosphorus compounds adversely affect the performance and lifetime of the catalysts which decontaminate the exhaust gas, and so they tend to be added to the lubricating oil at limited concentrations.

There has been considerable research into using lubricating oils to decrease friction loss and improve fuel cost-efficiency in internal combustion engines. A known method for decreasing viscosity resistance is to lower the viscosity of the lubricating oil for the internal combustion engine. This method decreases engine friction loss and lowers the viscosity of the lubricating oil.

Internal combustion engines which use a piston and cylinder, have a further problem in that some of the combustion gas is blown from between the piston and the cylinder during the combustion process, and leaks into the crank case as blow-by gas. It is known that the nitrogen oxides ($NO_x$) contained in this blow-by gas cause deterioration of the above-mentioned anti-wear agent ZnDTP, and although adequate anti-wear properties are retained, it is difficult to keep the amount of phosphorus compounds added to a low level.

It is very difficult to maintain the anti-wear properties of lubricating oil for internal combustion engines, particularly when the viscosity and the sulphur content of the lubricating oil for internal combustion engines must be kept low and when, in practice, blow-by gas is present in the engine crank case when engine oil is used. Consequently, recent increases in engine output have tended to result in an increase in the wear and scuffing of all internal combustion engine parts, particularly the moving valve parts such as the cam and tappet, which are subjected to exacting lubrication conditions.

Japanese Unexamined Patent Application No. H5-279686 suggests a lubricating oil composition for internal combustion engines comprising the following indispensable components in the lubricating oil base oil: (a) a molybdenum-based wear-reducing agent chosen from the group consisting of oxymolybdenum dithiocarbamate sulphide (MoDTC) and oxymolybdenumorganophosphorodithioate sulphide (MoDTP); (b) a friction modifier comprising fatty acid ester and/or organic amide; (c) a metallic detergent chosen from the group consisting of calcium sulphonate, magnesium sulphonate, calcium phenate and magnesium phenate; and (d) an ash-free detergent chosen from the group consisting of benzylamine, boron derivatives of benzylamine, alkenyl succinimides and boron derivatives of alkenyl succinimides. This invention aims to achieve good anti-wear properties and a low coefficient of friction, but does not go as far as to consider measures against the $NO_x$ contained in the blow-by gas.

The teaching of Japanese Unexamined Patent Application No. H7-150169 relates to a lubricating oil composition for internal combustion engines comprising the following indispensable components in the lubricating oil base oil: (A) a wear-reducing agent chosen from the group consisting of tungsten salts and molybdenum salts of dithioxanthogenic acid; (B) a friction modifier chosen from the group consisting of fatty acid esters and/or organic amides; and, if necessary, (C) (a) a metallic detergent chosen from the group consisting of calcium sulphonate, magnesium sulphonate, calcium phenate, magnesium phenate, calcium salicylate and magnesium salicylate, (b) an ash-free detergent chosen from the group consisting of benzylamine, boron derivatives of benzylamine, alkenyl succinimides and boron derivatives of alkenyl succinimides, and (c) an anti-wear agent chosen from the group consisting of zinc dithiophosphate (ZnDTP) and zinc dithiocarbamate (ZnDTC). This invention involves the indispensable use of tungsten salts or molybdenum salts of dithioxanthogenic acid, but it too does not go as far as to consider measures against the $NO_x$ contained in blow-by gas.

DESCRIPTION OF THE INVENTION

The present invention aims to provide a lubricating oil composition for internal combustion engines which has a low added concentration of the anti-wear agent ZnDTP and a low lubricating oil viscosity; does not involve the use of known molybdenum-based anti-wear agents such as molybdenum oxydithiocarbamate sulphide salts, molybdenum oxyorganophosphorodithiophosphate salts or molybdenum xanthogenate, or the use of boron compounds such as boronated dispersants or boronated fatty acid esters; and exhibits excellent wear resistance even under actual running conditions when the lubricating oil comes into contact with blow-by gas.

We have found a lubricating oil for internal combustion engines which overcomes the problems of scuffing and the wear resistance of moving valve parts under the above mentioned severe lubrication conditions.

The present invention relates to a lubricating oil composition for internal combustion engines, which has a high temperature high shear viscosity according to ASTM D 4683 in the range of from 2.1 to less than 2.9 mPas, which composition comprises lubricating base oil and (1) zinc dialkyldithiophosphate so that the phosphorus content in the oil is from 0.04 to 0.12 mass %, where the relationship between the primary and secondary alcohol in the zinc dialkyldithiophosphate alcohol residue satisfies the following expression in terms of the amount (mass %) of elemental phosphorus in the oil:

$$0.04 \leqq (Pri)+(Sec) \leqq 0.12$$

$$0 \text{ to } (Pri) \leqq 0.03$$

[where, (Pri) is the mass % of primary alcohol residue and (Sec) is the mass % of secondary alcohol residue], and (2) metallic detergent chosen from i) calcium alkylsalicylate and ii) a mixture of calcium alkylsalicylate and magnesium alkylsalicylate, so that the lubricating oil sulphated ash content is from 0.8 to 1.8 mass %, according to JIS K2272, and optionally (3) at most 2.0 mass % of friction modifier.

The lubricating oil compositions for internal combustion engines according to the present invention can be used in $NO_x$-containing atmospheres.

The compositions of the present invention have a relatively low high temperature high shear viscosity. The high temperature high shear viscosity is at least 2.1, preferably at least 2.2, more preferably at least 2.3, most preferably at least 2.4. The high temperature high shear viscosity is less than 2.9, preferably at most 2.85, more preferably at most 2.8, more preferably at most 2.7.

The zinc dialkyldithiophosphate (ZnDTP) used as a wear resistance agent in the present invention preferably has a secondary alcohol residue as the main component. The primary alcohol residue is present in an amount of 0.03 weight % or less, preferably 0.02 weight % or less in terms of the phosphorus content. The above mentioned alkyl group preferably has from 3 to 12 carbon atoms, more preferably from 3 to 8 carbon atoms.

The salicylate metal salt content is set by adjusting the amount of alkyl salicylate metal salt (2) so that the sulphated ash content of the lubricating oil is from 0.8 to 1.8 mass %, as stipulated in JIS K 2272. The aims of the present invention can generally be achieved by having a salicylate metal salt content of from 1 to 8 mass %, preferably from 4 to 6 mass % with respect to the 100 mass % of final product lubricating oil for internal combustion engines. When a mixture of calcium alkylsalicylate and magnesium alkylsalicylate is used, the calcium alkylsalicylate and magnesium alkylsalicylate are preferably mixed so that the amount of metallic magnesium content in the lubricating oil does not exceed the metallic calcium in the oil.

The composition of the present invention contains at most 2.0% wt of friction modifier, preferably at most 1.5% wt. Friction modifiers are well known in the art, e.g. U.S. Pat. No. 4,280,916 and U.S. Pat. No. 5,021,173. U.S. Pat. No. 4,280,916 discloses $C_8$–$C_{24}$ aliphatic acid mono amides, more specifically oleamide, for use as friction modifier. U.S. Pat. No. 5,021,173 discloses alcohol esters or hydroxyamide derivatives of carboxylic acids having a total from 24 to 90 carbon atoms and at least 2 carboxylic acid groups per molecule, e.g. the thermal condensation product of tall oil fatty acid typically containing 85 to 90 percent oleic or linoleic acids.

Preferred friction modifiers are fatty acid amides, more preferably unsaturated fatty acid amides.

Unsaturated fatty acid amide compounds for use in the present invention can be chosen from the group consisting of unsaturated fatty acid amides represented by the general formula below (Q)

$$CH_3—(CH_2)_n—CH=CH—(CH_2)_m—CONH_2 \quad (Q)$$

(where n+m=an integer from 8 to 20), preferably cis-9-octadecenoamide and cis-13-docosenoamide. Such compounds are sometimes less soluble at room temperature than common mineral oils and hydrocarbon-based synthetic oils. However, metallic detergent or ash-free dispersant mixed into the lubricating oil for internal combustion engines can stably be dissolved in the oil if the added concentration of these unsaturated fatty acid amide compounds is at most 0.35 mass %.

The unsaturated fatty acid amide compounds represented by general formula (Q) in the second invention have one unsaturated bond in the alkyl group in the molecule. These unsaturated fatty acid compounds have relatively high solubility and good thermal stability and oxidation stability at high temperatures, which makes that stable lubrication efficiency is maintained when they come into contact with blow-by gas containing $NO_x$ and the like. Consequently, unsaturated fatty acid amide compounds represented by the general formula (Q) are preferred for achieving the aims of the present invention. The total amount of unsaturated fatty acid amide compound added is preferably from 0.05 to 0.35 mass % with respect to 100 mass % of the product lubricating oil for internal combustion engines.

The wear resistance with respect to moving valves is markedly improved by the synergistic effect achieved by the combined use of the above mentioned metal alkylsalicylate and unsaturated fatty acid amide.

Thus, the present invention can provide a lubricating oil for internal combustion engines in which the concentration of the added wear resistance agent ZnDTP is low, at from 0.04 to 0.12 mass % in terms of the elemental phosphorus concentration in the oil; the viscosity is low, in that the high temperature high shear viscosity of the lubricating oil is from 2.4 to less than 2.9 mPas according to ASTM D 4683; and the wear resistance is excellent and stable, even under actual engine driving conditions when the lubricating oil comes into contact with blow-by gas.

There are no particular limitations regarding the lubricating base oil used in the present invention, and various conventional known mineral oils and synthetic-lubricating oils can be used. Effective mineral base oils include solvent-purified mineral oils; hydrogenated mineral oils disclosed in Japanese Patent Nos. 986988, 1128210, 1149503, 1302774, 1166979 and 971639, base oils produced from hydrogenated isomerized oils of Fischer-Tropsch-synthesized wax as disclosed in Petroleum Review 1998, April Edition, pp. 204–209; base oils produced by the plasma method stipulated in Japanese Unexamined Patent Application H2-40331; and hydrocarbon-based synthetic base oils and mixtures thereof. Unsaturated fatty acid ester base oil can be used in combination preferably up to 15%, in terms of mass ratio, when the product lubricating oil for internal combustion engines is taken as 100.

The lubricating oil compositions for internal combustion engines of the present invention may additionally contain an ash-free dispersant which is preferably admixed at from 5 to 10 mass %. Examples of types thereof include the polyalkenyl succinimides and polyalkenyl succininic acid esters disclosed in Japanese Patent Nos. 1367796, 1667140, 1302811 and 1743435, applied for by the Shell Group.

The lubricating oil compositions for internal combustion engines of the present invention may additionally contain an antioxidant.

Examples of antioxidants can include phenolic antioxidants such as 2,6-di-t-butylphenol, 4,4'-methylenebis-( 2,6-di-t-butylphenol) and the like, and amine-based antioxidants such as alkylated diphenylamine, phenyl-α-naphthylamine, alkylated α-naphthylamine and the like, and these are preferably used at from 0.01 to 2 mass %.

It can also be effective to add various other additives, as desired, to the lubricating oil composition of the present invention. Examples of viscosity index improvers include the styrene-butadiene copolymers, styrene-isoprene stellate copolymers and the polymethacrylate-based and ethylene-propylene copolymers and the like disclosed in Japanese Patent Nos. 954077, 1031507, 1468752, 1764494 and 1751082, and these are used at from 1 to 20 mass %. Similarly, dispersing-type viscosity index improvers comprising copolymerized polar monomer containing nitrogen atoms and oxygen atoms in the molecule can also be used therein. Polymethacrylate disclosed in Japanese Patent Nos. 1195542 and 1264056, and the like, are used as effective pour point depressants.

Alkenyl succinic acid or ester moieties thereof, benzotriazole-based compounds and thiodiazole-based compounds and the like can be used as rust preventers.

Dimethyl polycyclohexane, polyacrylate and the like can be used as defoaming agents.

The present invention is further illustrated by means of the following working and comparative examples, although the present invention is not limited to these working examples.

The resistance to moving valve wear in a $No_x$ environment was appraised for each working example test oil according to the JASO method for testing moving valve wear (JASO M328-95). It was found that test accuracy could be markedly improved by controlling the humidity and the temperature of the air intake during these engine tests. All of the working examples of the present invention were appraised according to this method.

In all test oils, a mixture comprising solvent-purified base oil and oil obtained from hydrogenation and isomerization of wax by the Fischer-Tropsch method was used as the base oil. The base oil component had a kinematic viscosity of 24 $mm^2/s$ at 40° C., 4.8 $mm^2/s$ at 100° C., a viscosity index of 122, the sulphur content in the oil was 0.3 mass %, and the aromatic content was 1.4 mass %. Moreover, the test oil was adjusted according to the amount of viscosity index improver added.

The additive compositions for all test oils were based on the additive compositions for standard engine oil. Specifically, metallic detergents, wear resistance agents, ash-free dispersants, pour point depressants and defoaming agents were combined, and these had API SG grade properties.

The unsaturated fatty acid amide was a commercial product having 18 carbon atoms as the main component.

The additives used, amounts used and units in the table are as described below.

Metallic detergent A: Calcium salicylate, calcium content 5.5 mass %, TBN: 150 mg KOH/g Metallic detergent B: Calcium salicylate, calcium content: 3.4 mass %, TBN: 80 mg KOH/g Metallic detergent C: Magnesium salicylate, magnesium content: 7.2 mass %, TBN: 340 mg KOH/g Metallic detergent D: Calcium salicylate, calcium content: 10.3 mass %, TBN: 290 mg KOH/g Metallic detergent E: Calcium sulphonate, calcium content: 5.2 mass %, TBN: 140 mg KOH/g Metallic detergent F: Calcium sulphonate, calcium content: 2.4 mass %, TBN: 65 mg KOH/g Metallic detergent G: Magnesium sulphonate, magnesium content: 9.5 mass %, TBN: 385 mg KOH/g Metallic detergent H: Calcium sulphonate, calcium content: 12.0 mass %, TBN: 300 mg KOH/g (A to H above include substances remixed with commercial products)

Wear resistance agent A: Secondary ZnDTP: commercial product that is a mixture having alkyl groups comprising 3 and 6 carbon atom chains, where the alcohol residue thereof is secondary Wear resistance agent B: Primary ZnDTP: commercial product that has alkyl groups comprising an 8 carbon atom chain, where the alcohol residue thereof is primary Viscosity index improver: commercial styrene-isoprene star copolymer Other additives: ash-free dispersant, pour point depressant, antifoaming agent In the table, mass % is the unit for the Ca, Mg, P, B and sulphate ash components, the unit for the kinematic viscosity is $mm^2/s$, and the unit for the shear viscosity is mPas.

Measurements in the table were performed according to JASO M328-95, controlling the air intake temperature and humidity.

TABLE 1

| | Moving valve wear test | | | | |
|---|---|---|---|---|---|
| Examples | Comp. 1 | Comp. 2 | Comp. 3 | Comp. 4 | Comp. 5 |
| Metallic detergent E | 5.2 | — | 5.2 | 5.2 | 5.2 |
| Metallic detergent F | — | 4.7 | — | — | — |
| Metallic detergent G | — | 1.1 | — | — | — |
| Fatty acid amide | — | — | — | — | — |
| Wear resistance agent A | 0.5 | 0.5 | 1.0 | 0.5 | 0.3 |
| Wear resistance agent B | — | — | — | — | 0.3 |
| Base oil | 84.8 | 83.9 | 84.3 | 80.0 | 84.9 |
| Viscosity index improver | 1.2 | 1.5 | 1.2 | 6.0 | 1.0 |
| Additives | 8.3 | 8.3 | 8.3 | 8.3 | 8.3 |
| Ca | 0.28 | 0.12 | 0.28 | 0.28 | 0.28 |
| Mg | — | 0.10 | — | — | — |
| P | 0.05 | 0.05 | 0.10 | 0.05 | 0.05 |
| B | — | — | — | — | — |
| Total Sulphated ash | 1.02 | 1.00 | 1.11 | 1.02 | 1.02 |
| Sulphated ash (originating from detergent) | 0.92 | 0.89 | 0.92 | 0.92 | 0.92 |
| Kinematic viscosity 40° C. | 43.2 | 42.3 | 43.0 | 85.9 | 45.2 |
| Kinematic viscosity 100° C. | 7.5 | 7.5 | 7.6 | 11.8 | 7.9 |
| High temperature high shear viscosity 150° C. | 2.6 | 2.6 | 2.6 | 3.7 | 2.6 |
| Wear (μm) | 21.2 | 24.8 | 10.3 | 19.6 | 35.6 |

TABLE 2

| Examples | 1 | 2 | Comp. 6 | 3 | Comp. 7 |
|---|---|---|---|---|---|
| Metallic detergent A | 5.2 | — | — | 5.2 | — |
| Metallic detergent B | — | 3.5 | — | — | — |
| Metallic detergent C | — | 1.3 | — | — | — |
| Metallic detergent D | — | — | — | — | — |
| Metallic detergent E | — | — | 5.2 | — | — |
| Metallic detergent F | — | — | — | — | 4.7 |
| Metallic detergent G | — | — | — | — | 1.1 |
| Metallic detergent H | — | — | — | — | — |
| Fatty acid amide | — | — | 0.3 | 0.3 | 0.3 |
| Wear resistance agent A | 0.5 | 0.5 | 0.5 | 0.5 | 0.5 |
| Wear resistance agent B | — | — | — | — | — |
| Base oil | 84.2 | 84.4 | 84.5 | 83.9 | 83.6 |
| Viscosity index improver | 1.8 | 2.0 | 1.2 | 1.8 | 1.5 |
| Additives | 8.3 | 8.3 | 8.3 | 8.3 | 8.3 |
| Ca | 0.28 | 0.12 | 0.28 | 0.28 | 0.12 |
| Mg | — | 0.10 | — | — | 0.10 |
| P | 0.05 | 0.05 | 0.05 | 0.05 | 0.05 |
| B | — | — | — | — | — |

TABLE 2-continued

| Examples | 1 | 2 | Comp. 6 | 3 | Comp. 7 |
|---|---|---|---|---|---|
| Total sulphated ash | 1.02 | 1.00 | 1.02 | 1.02 | 1.00 |
| Sulphated ash (originating in the detergent) | 0.92 | 0.89 | 0.92 | 0.92 | 0.89 |
| Kinematic viscosity 40° C. | 42.9 | 43.4 | 45.4 | 44.5 | 45.5 |
| Kinematic viscosity 100° C. | 7.5 | 7.6 | 7.9 | 7.8 | 7.8 |
| High temperature high shear viscosity at 150° C. | 2.6 | 2.6 | 2.6 | 2.6 | 2.6 |
| Wear (μm) | 4.9 | 5.5 | 3.1 | 1.0 | 4.0 |

TABLE 3

| Working Examples | 4 | 5 | 6 | Comp. 8 | Comp. 9 |
|---|---|---|---|---|---|
| Metallic detergent A | — | 5.2 | — | — | — |
| Metallic detergent B | 3.5 | — | 3.5 | — | — |
| Metallic detergent C | 1.3 | — | 1.3 | — | — |
| Metallic detergent D | — | — | — | — | — |
| Metallic detergent E | — | — | — | — | 5.2 |
| Metallic detergent F | — | — | — | 4.7 | — |
| Metallic detergent G | — | — | — | 1.1 | — |
| Metallic detergent H | — | — | — | — | — |
| Fatty acid amide | 0.3 | 0.3 | — | 0.3 | 0.3 |
| Wear resistance agent A | 0.5 | 1.0 | 1.0 | 1.0 | 0.5 |
| Wear resistance agent B | — | — | — | — | — |
| Base oil | 84.1 | 83.4 | 83.9 | 83.1 | 79.7 |
| Viscosity index improver | 2.0 | 1.8 | 2.0 | 1.5 | 6.0 |
| Additives | 8.3 | 8.3 | 8.3 | 8.3 | 8.3 |
| Ca | 0.12 | 0.28 | 0.12 | 0.12 | 0.28 |
| Mg | 0.10 | — | 0.10 | 0.10 | — |
| P | 0.05 | 0.10 | 0.10 | 0.10 | 0.05 |
| B | — | — | — | — | — |
| Total Sulphated ash | 1.00 | 1.11 | 1.09 | 1.09 | 1.02 |
| Sulphated ash (originating in the detergent) | 0.89 | 0.92 | 0.89 | 0.89 | 0.92 |
| Kinematic viscosity 40° C. | 44.8 | 44.2 | 43.5 | 45.7 | 87.3 |
| Kinematic viscosity 100° C. | 7.8 | 7.7 | 7.6 | 7.9 | 12.0 |
| High temperature high shear viscosity at 150° C. | 2.6 | 2.6 | 2.6 | 2.6 | 3.7 |
| Wear (μm) | 2.1 | 1.3 | 4.5 | 2.3 | 4.8 |

TABLE 4

| Working Examples | Comp. 10 | Comp. 11 | 7 | Comp. 12 | 8 |
|---|---|---|---|---|---|
| Metallic detergent A | — | 5.2 | 5.2 | — | — |
| Metallic detergent B | — | — | — | — | — |
| Metallic detergent C | — | — | — | — | — |
| Metallic detergent D | — | — | — | — | 5.0 |
| Metallic detergent E | 5.2 | — | — | — | — |
| Metallic detergent F | — | — | — | — | — |
| Metallic detergent G | — | — | — | — | — |
| Metallic detergent H | — | — | — | 4.2 | — |
| Fatty acid amide | 0.3 | — | 0.3 | 0.3 | 0.3 |
| Wear resistance agent A | 0.3 | 0.3 | 0.3 | 0.5 | 0.5 |
| Wear registance agent B | 0.3 | 0.3 | 0.3 | — | — |
| Base oil | 84.6 | 84.9 | 84.6 | 85.7 | 84.9 |
| Viscosity index improver | 1.0 | 1.0 | 1.0 | 1.0 | 1.0 |
| Additives | 8.3 | 8.3 | 8.3 | 8.3 | 8.3 |
| Ca | 0.28 | 0.28 | 0.28 | 0.50 | 0.52 |
| Mg | — | — | — | — | — |
| P | 0.05 | 0.05 | 0.05 | 0.05 | 0.05 |
| B | — | — | — | — | — |
| Total Sulphated ash | 1.02 | 1.80 | 1.02 | 1.81 | 1.80 |

TABLE 4-continued

| Working Examples | Comp. 10 | Comp. 11 | 7 | Comp. 12 | 8 |
|---|---|---|---|---|---|
| Sulphated ash (originating in the detergent) | 0.92 | 1.69 | 0.92 | 1.70 | 1.69 |
| Kinematic viscosity 40° C. | 44.3 | 44.5 | 43.6 | 42.9 | 44.4 |
| Kinematic viscosity 100° C. | 7.8 | 7.8 | 7.7 | 7.6 | 7.8 |
| High temperature high shear viscosity at 150° C. | 2.6 | 2.6 | 2.6 | 2.6 | 2.6 |
| Wear (μm) | 6.2 | 8.9 | 1.7 | 4.2 | 1.6 |

TABLE 5

Storage stability test (room temperature, 10 days)

| Working Examples | 1 | 9 | 10 | 3 |
|---|---|---|---|---|
| Metallic detergent A | 5.2 | 5.2 | 5.2 | 5.2 |
| Fatty acid amide | 0.0 | 0.1 | 0.2 | 0.3 |
| Wear resistance agent A | 0.5 | 0.5 | 0.5 | 0.5 |
| Base oil | 84.2 | 84.1 | 84.0 | 83.9 |
| Viscosity index improver | 1.8 | 1.8 | 1.8 | 1.8 |
| Additives | 8.3 | 8.3 | 8.3 | 8.3 |
| Amount precipitated (mass %) | None | None | None | None |

TABLE 6

Storage stability test (room temperature, 10 days)

| Examples | Comp. 13 | Comp. 14 | Comp. 15 |
|---|---|---|---|
| Metallic detergent A | 5.2 | 5.2 | 5.2 |
| Fatty acid amide | 0.4 | 0.5 | 0.6 |
| Wear resistance agent A | 0.5 | 0.5 | 0.5 |
| Base oil | 83.8 | 83.7 | 83.6 |
| Viscosity index improver | 1.8 | 1.8 | 1.8 |
| Additives | 8.3 | 8.3 | 8.3 |
| Amount precipitated (mass %) | 0.01 | 0.03 | 0.07 |

On comparing Comparative Example 1 with Working Example 1 it is clear that calcium alkylsalicylate offers better wear resistance than calcium alkylsulphonate. Similarly, on comparing Comparative Example 2 with Working Example 2, it is clear that a mixture of calcium alkylsalicylate and magnesium alkylsalicylate is better than a mixture of calcium alkylsulphonate and magnesium alkylsulphonate.

A comparison of Working Example 1 with Working Example 3, and Working Example 2 with Working Example 4 reveals that the addition of unsaturated fatty acid amide improves wear resistance regardless of the type of metallic detergent.

Test oils were prepared using the lubricating oil composition of Working Example 1 (used in the measuring valve test) as the base, with from 0 to 0.6 mass % of unsaturated fatty acid amide added at increments of 0.1, and storage stability tests were performed at room temperature for 10 days (Working Examples 1, 9, 10, 3 and Comparative Examples 13, 14 and 15). After the test, the presence or absence of precipitate was determined, and if precipitate had formed, the amount thereof was measured.

The results show that when 0.4 mass % or more of unsaturated fatty acid amide was added, precipitate formed in proportion to the amount added, and the addition of such amounts is not practical for these specific amides.

The above mentioned working examples show that even when the amount of elemental phosphorus-containing wear resistance agent contained in the lubricating oil is low and the viscosity is low, the use of calcium alkylsalicylate and optionally magnesium alkylsalicylate, and optionally the addition of a small amount of unsaturated fatty acid amide can improve the wear resistance.

What is claimed is:

1. A lubricating oil composition having a sulfated ash content and being free of molybdenum for internal combustion engines which has a high temperature high shear viscosity according to ASTM D 4683 in the range of from 2.1 to less than 2.9 mPas, which composition comprises lubricating base oil and (1) zinc dialkyldithiophosphate having a primary and/or secondary alcohol mixed therewith in a residue so that the phosphorus content in the oil is from 0.04 to 0.12 mass %, wherein the relationship between the primary and secondary alcohol in the zinc dialkyldithiophosphate alcohol residue satisfies the following expression in terms of the amount (mass %) of elemental phosphorus in the oil:

$$0.04 \leqq (Pri)+(Sec) \leqq 0.12$$

$$(Pri)=0 \text{ to } 0.03$$

where, (Pri) is the mass % of primary alcohol residue and (Sec) is the mass % of secondary alcohol residue, and (2) a metallic detergent selected from the group consisting of calcium alkylsalicylate and ii) a mixture of calcium alkylsalicylate and magnesium alkylsalicylate wherein the lubricating oil sulphated ash content is from 0.8 to 1.8 mass %, according to JIS K2272, and optionally, (3) at most 2.0 mass % of friction modifier.

2. A lubricating oil composition according to claim 1, wherein the zinc dialkyldithiophosphate has an alkyl group of from 3 to 12 carbon atoms.

3. A lubricating oil composition according to claim 1, wherein the alkylsalicylate compound(s) content is from 1 to 8% mass of the lubricating oil composition.

4. A lubricating oil composition according to claim 1 wherein the amount of metallic magnesium does not exceed the amount of calcium.

5. A lubricating oil composition according to claim 1 wherein the friction modifier is fatty acid amide.

6. A lubricating oil composition according to claim 1 wherein the friction modifier is present in an amount of from 0.05 to 0.35 mass %, based on total composition.

* * * * *